US009579554B1

(12) United States Patent
Madden et al.

(10) Patent No.: US 9,579,554 B1
(45) Date of Patent: Feb. 28, 2017

(54) SYSTEM AND METHOD TO PITCH BALLS USING ONE POWERED WHEEL

(71) Applicant: Sports Attack, Inc., Verdi, NV (US)

(72) Inventors: Bradley S Madden, Truckee, CA (US); Douglas L Boehner, Verdi, NV (US)

(73) Assignee: Sports Attack, LLC, Revo, NV (US)

( * ) Notice: Subject to any disclaimer, the term of this patent is extended or adjusted under 35 U.S.C. 154(b) by 0 days.

(21) Appl. No.: 14/963,593

(22) Filed: Dec. 9, 2015

(51) Int. Cl.
*A63B 69/40* (2006.01)
*F41B 4/00* (2006.01)
*A63B 69/00* (2006.01)

(52) U.S. Cl.
CPC ..... *A63B 69/406* (2013.01); *A63B 69/0002* (2013.01); *A63B 69/408* (2013.01); *F41B 4/00* (2013.01); *A63B 2069/0008* (2013.01); *A63B 2069/402* (2013.01); *A63B 2210/50* (2013.01)

(58) Field of Classification Search
CPC ..... A63B 69/406; A63B 69/0002; A63B 2069/0008; A63B 2069/402; F41B 4/00
USPC ..... 124/6, 78; 473/422, 451
See application file for complete search history.

(56) References Cited

U.S. PATENT DOCUMENTS 1,211,738 A * 1/1917 Marty ..... A63B 69/406 124/1
4,080,950 A * 3/1978 Paulson ..... A63B 69/406 124/1
RE30,703 E * 8/1981 Paulson ..... A63B 69/406 124/1
4,323,047 A * 4/1982 McIntosh ..... A63B 69/406 124/1
5,826,568 A * 10/1998 Van Ross, Jr. ..... A63B 69/406 124/6
5,832,909 A * 11/1998 Grant ..... A63B 69/406 124/6
6,402,640 B1 * 6/2002 Stuart ..... A63B 69/406 124/6
6,672,297 B1 * 1/2004 Liao ..... A63B 69/0002 124/6
6,732,724 B1 * 5/2004 Paulson ..... A63B 69/406 124/6
6,863,059 B1 * 3/2005 Lee ..... F41B 4/00 124/6
6,895,949 B1 * 5/2005 Stephens ..... F41B 4/00 124/6
6,983,741 B2 * 1/2006 Donald ..... A63B 69/406 124/6
7,231,913 B2 * 6/2007 Wilson ..... A63B 69/406 124/6
7,290,540 B2 * 11/2007 Lu ..... A63B 69/0002 124/6
7,383,832 B2 * 6/2008 Soberg ..... A63B 69/0002 124/6
7,806,788 B1 * 10/2010 Neuman ..... A63B 69/408 124/4
7,900,618 B1 * 3/2011 Angermeier ..... A63B 69/406 124/6

(Continued)

*Primary Examiner* — Alexander Niconovich
(74) *Attorney, Agent, or Firm* — Fincham Downs, LLC; Carson C. K. Fincham

(57) ABSTRACT

A system and method to pitch balls using one powered wheel. The system and method comprise a single powered wheel and at least two pinch pads configured with an aperture between them to allow a player to see the ball throughout the length of its descent into the aperture prior to being pitched.

26 Claims, 11 Drawing Sheets

(56) References Cited

U.S. PATENT DOCUMENTS

| | | | | |
|---|---|---|---|---|
| 7,958,876 | B2 * | 6/2011 | Lay | A63B 69/406 124/6 |
| 8,001,954 | B2 * | 8/2011 | Boehner | A63B 69/406 124/78 |
| 8,074,633 | B2 * | 12/2011 | Grant | A63B 69/406 124/78 |
| 8,365,711 | B2 * | 2/2013 | Kusiak | A63B 69/0002 124/49 |
| 8,707,942 | B2 * | 4/2014 | Lu | F41B 4/00 124/1 |
| 9,180,355 | B1 * | 11/2015 | Boehner | F41B 4/00 |
| 2006/0201490 | A1 * | 9/2006 | Villar | F41B 4/00 124/6 |
| 2012/0097145 | A1 * | 4/2012 | Lu | A63B 69/406 124/78 |

* cited by examiner

SYSTEM AND METHOD TO PITCH BALLS USING ONE POWERED WHEEL

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

This invention relates to devices for practicing sports, and in particular, this invention relates to a system and method for simulating a pitched or thrown ball such as a baseball or softball.

Currently, there are many devices for throwing a ball, including the throwing of baseballs and softballs as well as cricket balls, lacrosse balls, tennis balls, etc. for players to practice with. Typically these devices have one or more wheels that engage the ball as it passes through the wheels and impart speed and spin to the ball. Two wheel devices have become the standard over the past several years while three wheel devices are also common. One wheel devices, while providing fewer options and features, remain popular due to simpler design, ease of use and lower cost.

Pitching machines of different configurations, whether equipped with a single wheel, two wheels or three wheels, are able to effectively replicate one or more particular pitch types with the same speed, trajectory and spin enabling players to practice hitting each type of pitch, particularly those that are difficult for an individual batter to hit.

SUMMARY

The present invention provides an apparatus and method for throwing practice balls that may be presented to a person in need of hitting or fielding practice. The apparatus includes a ball propelling head mounted on a yoke frame that is, in turn, mounted on a stand. The ball propelling head includes a single throwing wheel powered by a variable speed motor that propels a ball dropped into a chute on the ball propelling head. A control panel attached to the ball propelling head provides access to a speed control for the motor driving a ball pitched from the propelling head at a desired speed. The invention also provides a method for pitching practice balls wherein the balls are delivered to a person in need of hitting practice balls that pass through an aperture (or opening) formed between the single powered wheel and one or more pinch pads mounted opposite the throwing wheel and set at an angle so that a surface of each pinch pad engages the ball as it is engaged by the wheel. The yoke frame holding the ball propelling head is configured to pivot on the stand so that an operator of the device can aim the device to throw a pitch or a fly ball.

The invention is an apparatus for pitching practice balls comprising: a wheel propelling head having a single wheel and at least one pinch pad arranged to define an aperture between the wheel and the at least one pinch pad; a motor attached to the wheel and configured to power the wheel as it spins; a support post at the base of the yoke frame on which the wheel propelling head is mounted; a stand with a mounting plate for engaging the support post and holding the yoke frame. The apparatus may also include a fine adjustment subsystem incorporated in the stand that allows for quick and easy adjustment of the pitch location between pitches in and around a strike zone of the batter.

Another aspect of the invention is an apparatus for pitching practice of stick-hittable balls comprising: a support post for a stick-hittable ball propelling head; a yoke frame mounted on the support post for the stick-hittable ball propelling head; a ball propelling head including one variable speed motor powered wheel and at least one pinch pad with an angled surface, wherein the wheel and the at least one pinch pad defines an aperture through which aperture the stick-hittable ball passes before the stick-hittable ball is launched; and, the at least one variable speed motor held within and attached to the yoke frame; a control panel attached proximate the motor plate providing access to a speed control for the motor driving a stick-hittable ball propelling head; and a fine adjustment subsystem that allows for quick and easy adjustment of the pitch location between pitches in and around a strike zone of the batter.

Yet another aspect of the invention is a method for pitching practice balls comprising: delivering practice balls in a practice ball apparatus through an aperture to a person standing in front of the practice ball apparatus to a wheel motor driven ball propelling head supported by a yoke frame that pivots on a stand to aim the ball; launching the ball to the person standing in front of the apparatus to practice hitting or fielding the launched ball; and quickly and easily adjusting the ball propelling head to change the pitch location between pitches in and around a strike zone of the batter.

BRIEF DESCRIPTION OF THE DRAWINGS

For a better understanding of the present invention, and to show more clearly how it is configured and functions, reference will now be made, by way of example, to the accompanying drawings. The drawings show embodiments of the present invention in which.

DETAILED DESCRIPTION

Figure 1A:
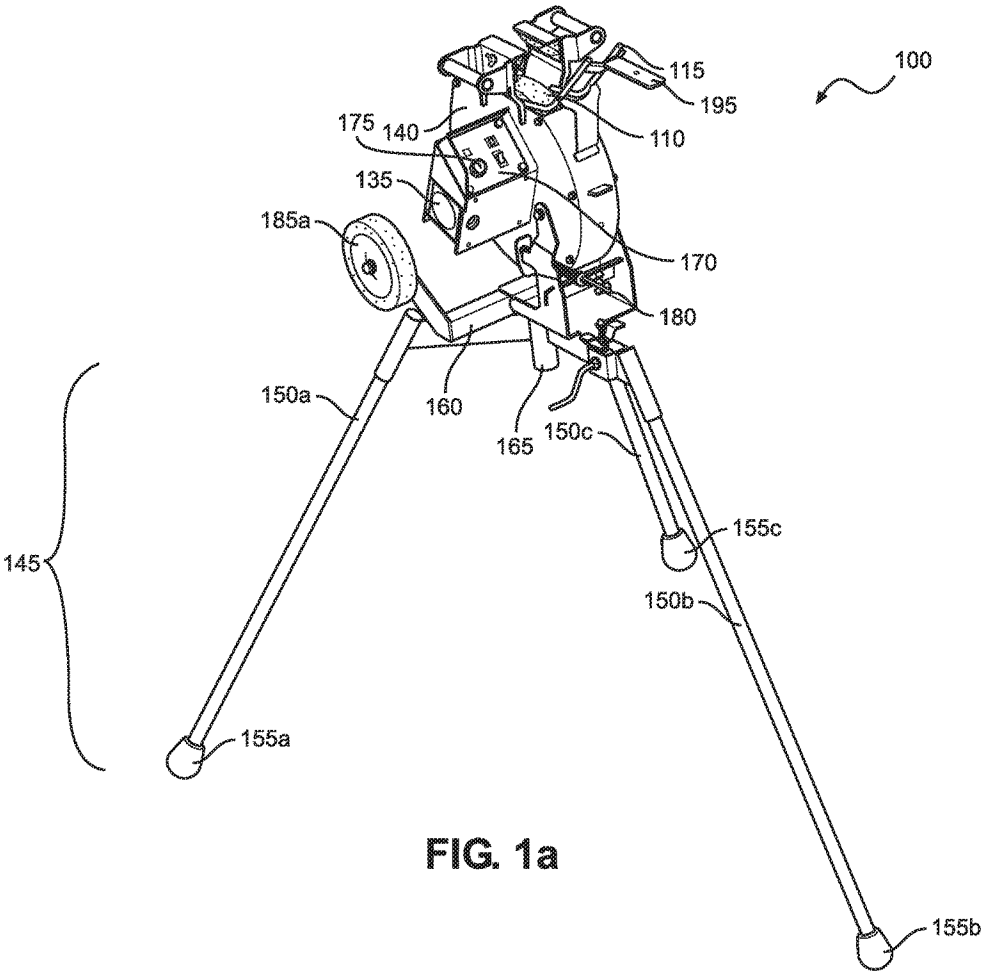
FIGS. 1*a-k* show various views of a system to pitch balls.
Figure 1B:
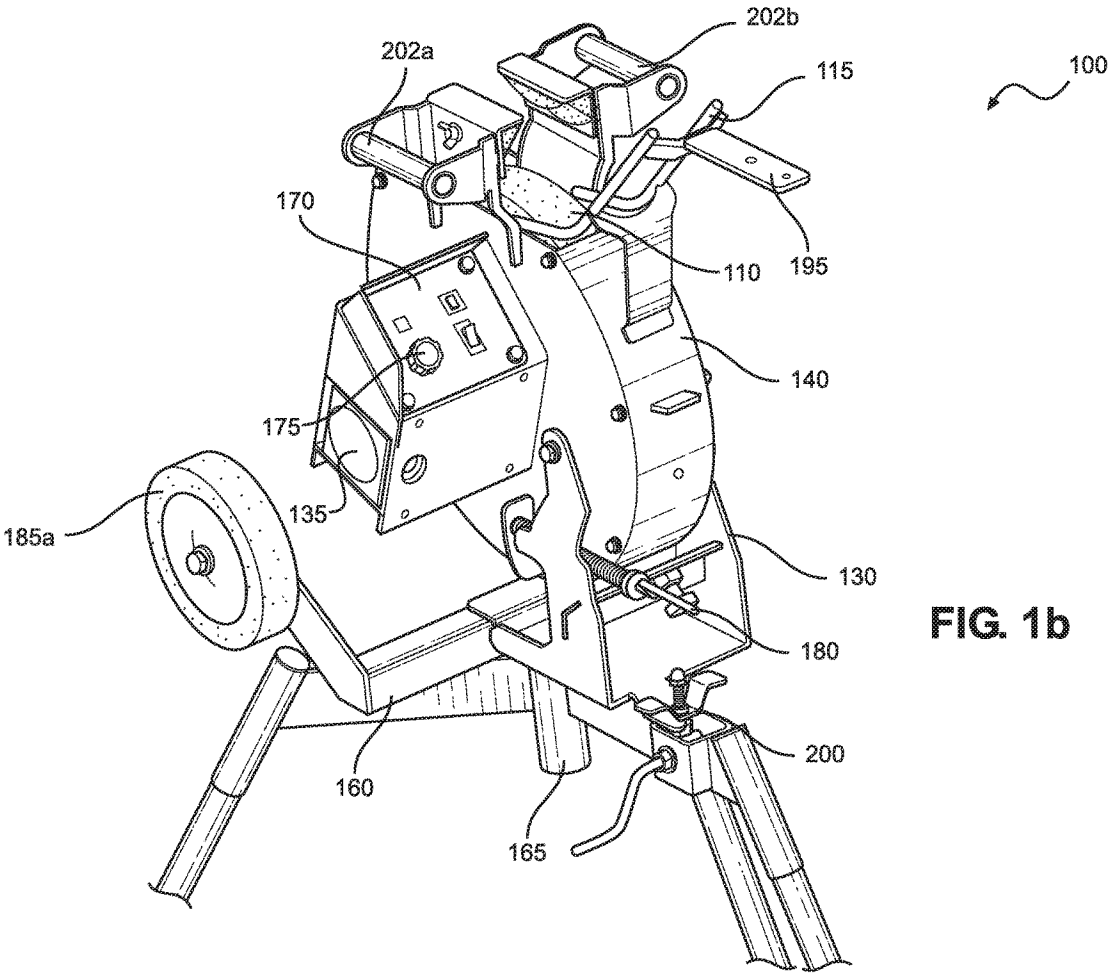

The present invention will now be described more fully with reference to the accompanying drawings. It should be understood that the invention may be embodied in many different forms and should not be construed as limited to the embodiments set forth herein. Throughout the FIGS. 1-3, like elements of the invention are referred to by the same reference numerals for consistency purposes.

Figure 1C:
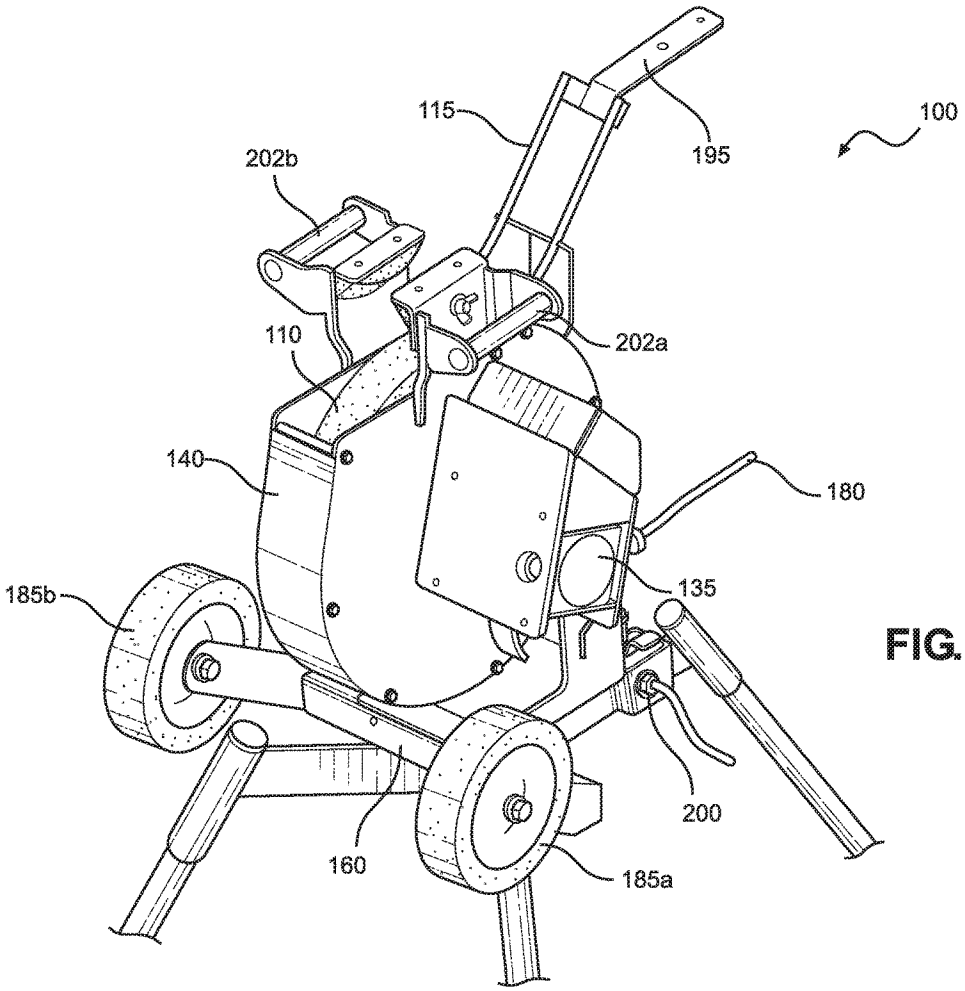
Figure 1E:
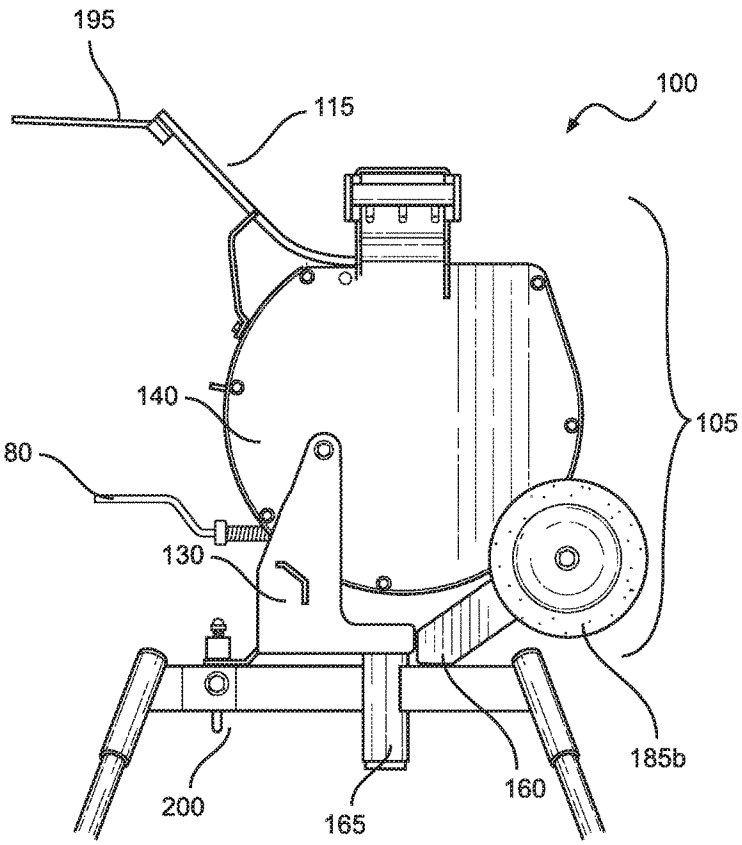
Figure 1D:
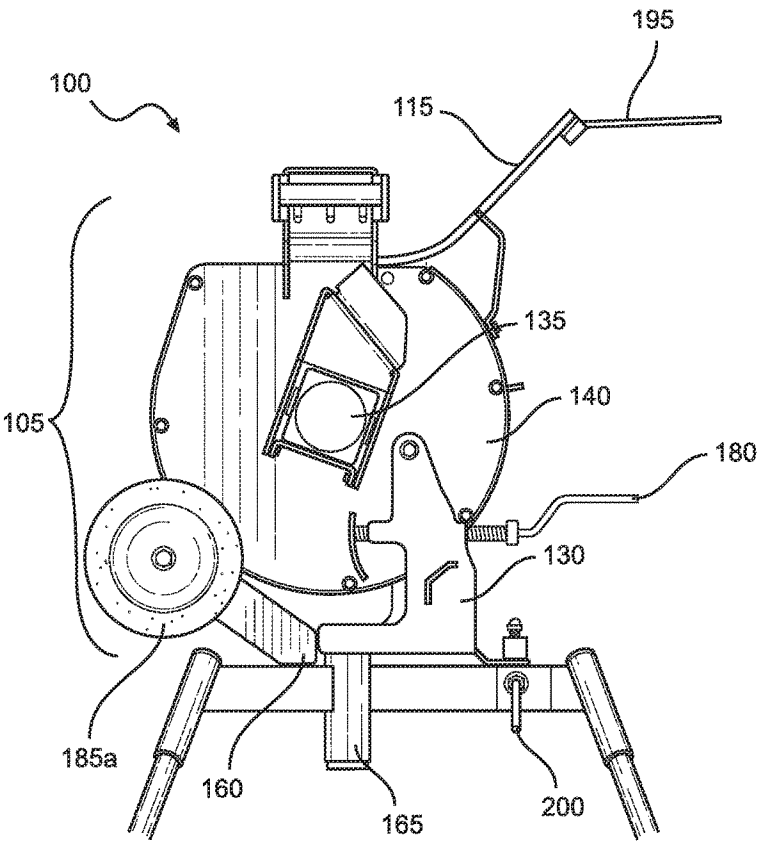
Figure 1G:
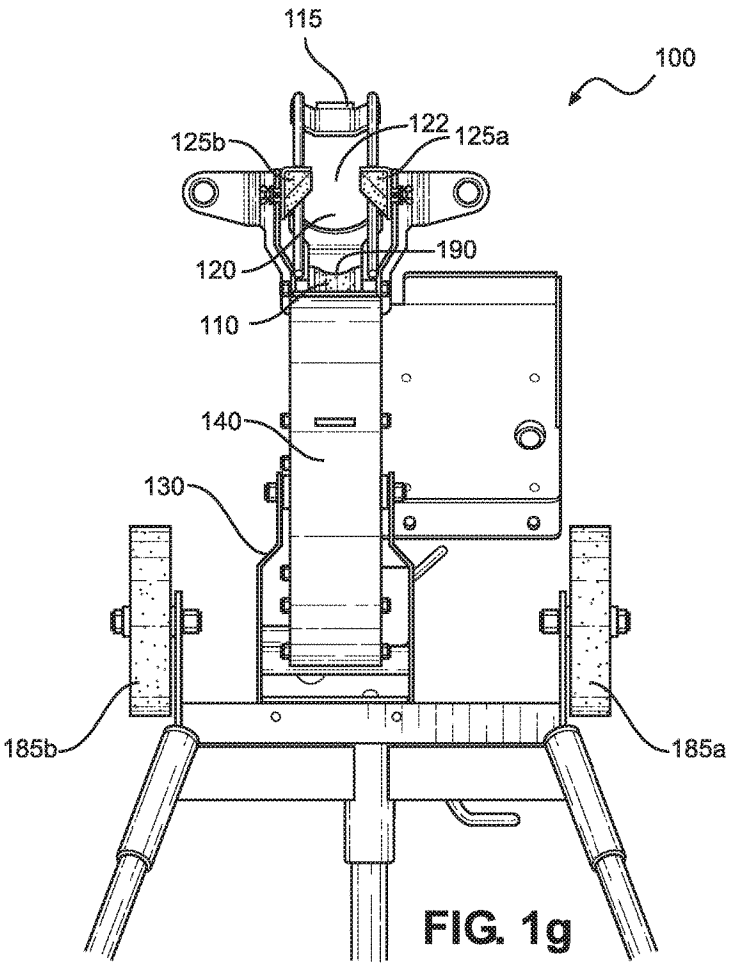
Figure 1F:
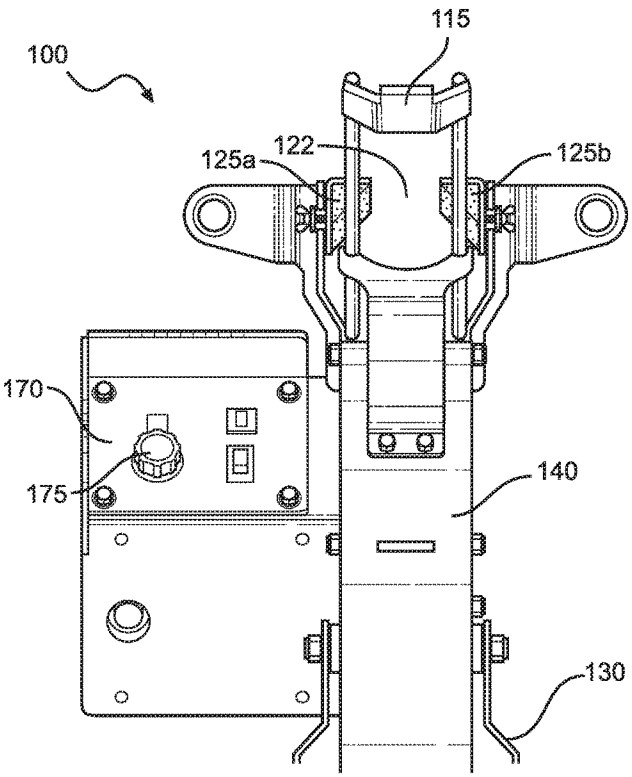
Figure 1H:
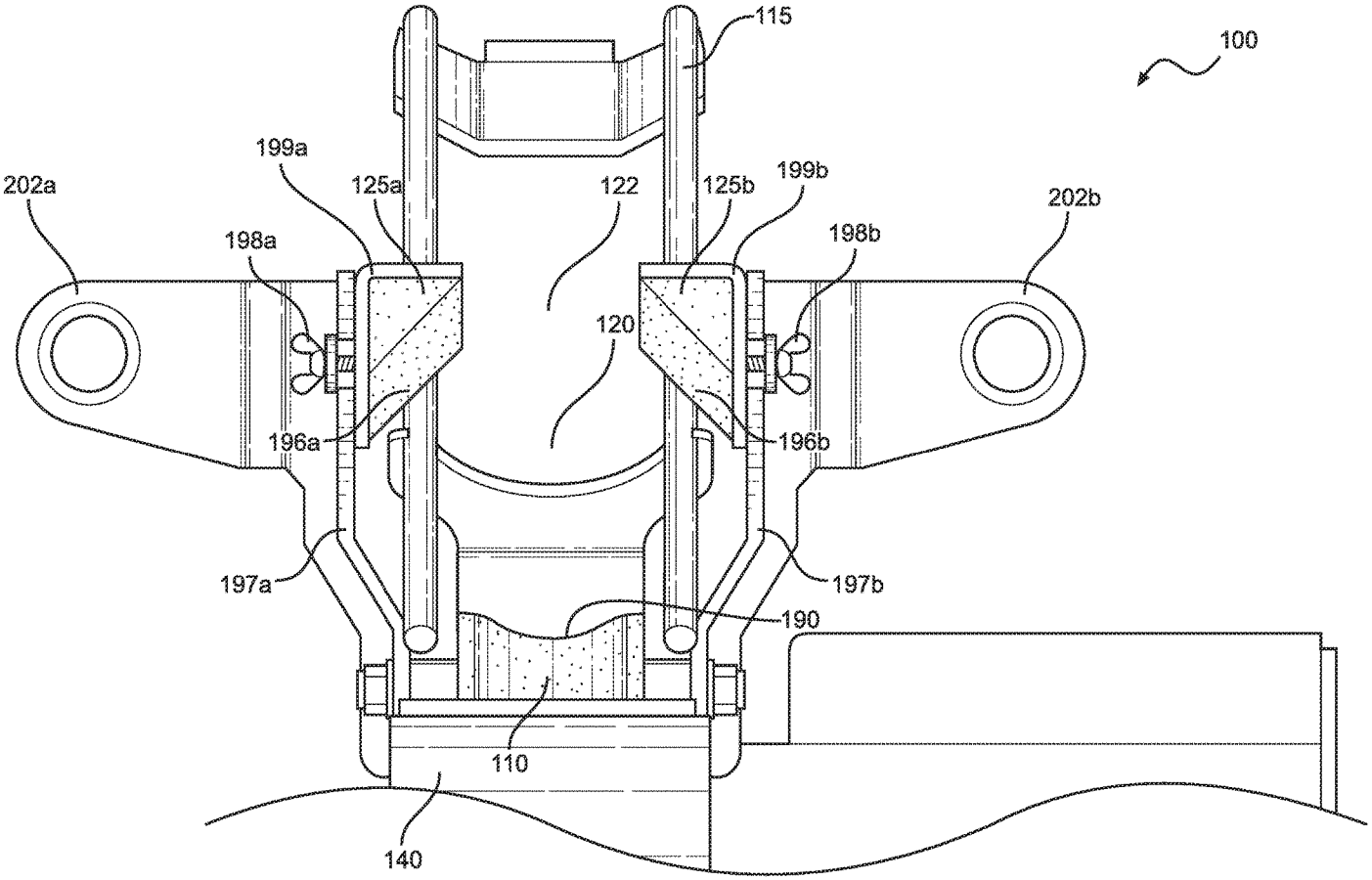
Figure 1I:
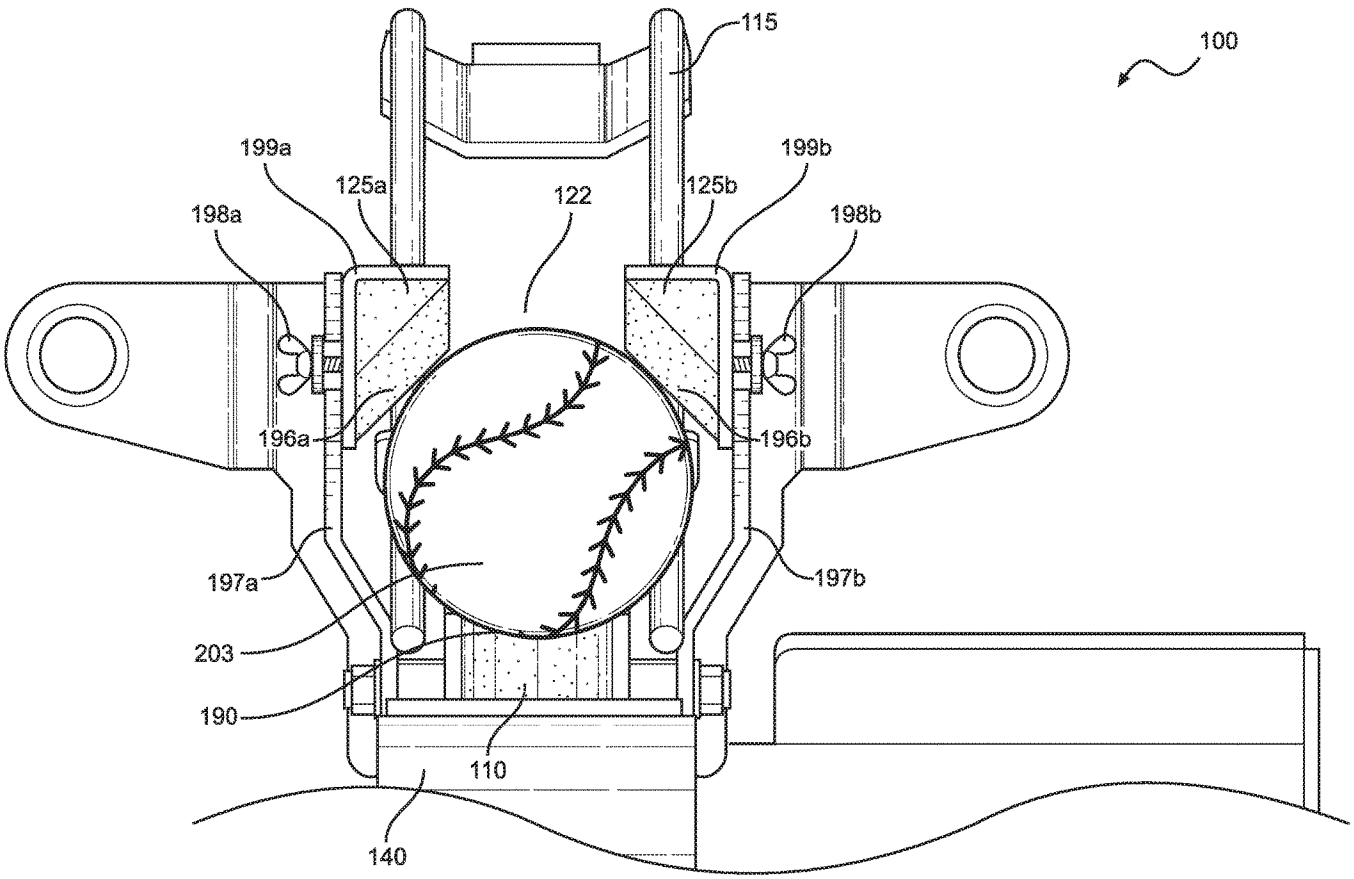
Figure 1J:
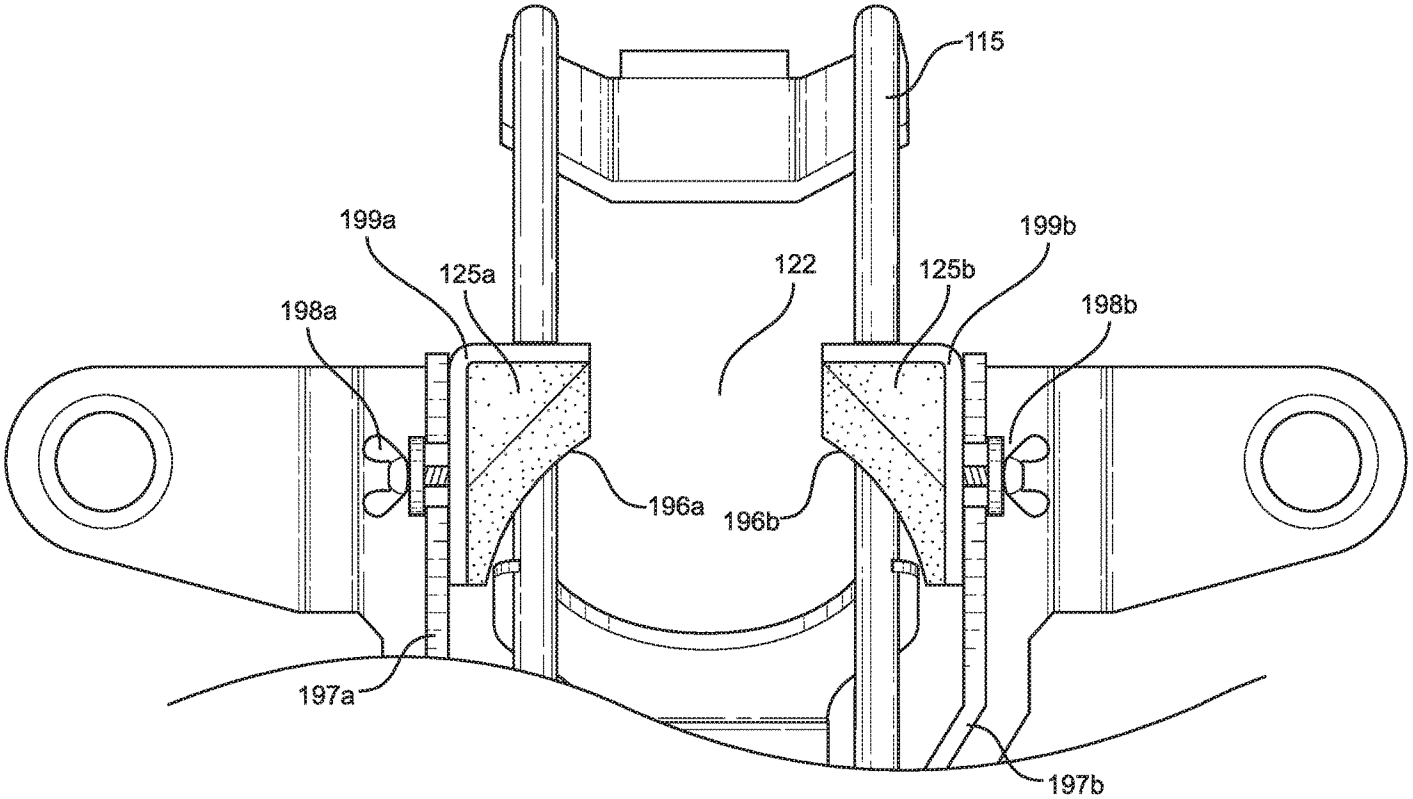

FIGS. 1*a-h* show eight views of a ball pitching apparatus 100: FIG. 1*a* is a rear angled perspective view; (FIG. 1*b*) is a close-up rear angled perspective view; FIG. 1*c* is a front angled perspective view; FIG. 1*d* and FIG. 1*e* each show a side view; FIG. 1*f* is a rear view; FIG. 1*g* is a front view; FIG. 1*h* is a close up front view; FIG. 1*i* is a close up front view with a ball; and FIG. 1*j* is a close up view of pinch pads with a curved surface. In describing ball pitching apparatus 100, reference to all eight figures is made.

Ball pitching apparatus 100 has a one-wheel ball propelling head 105 (see FIG. 1*d* and FIG. 1*e*) having a single powered wheel 110. Wheel 110 contacts balls as they roll down chute 115 and contact wheel 110, launching them towards a player for batting practice, who is usually positioned in front of the apparatus at a hitting distance. It should be understood that the device is adjustable for pitching at different distances, including for purposes of batting practice at the youth level, or for practice with fielding of ground balls, line drives or pop flies.

Practice balls are placed on the end of chute 115, down which the ball rolls. Chute 115 allows the practicing player to see the ball as it approaches an aperture 120 formed between wheel 110 and pinch pads 125*a*, 125*b* before the ball contacts wheel 110. At the same time, the ball is snubbed by pinch pads 125*a*, 125*b* causing a backward oriented spin to be imparted to the ball as it engages wheel 110 and is launched towards the player. This visibility of the ball throughout the descent down chute 115 and through acceleration allows the batter to get a sense of timing in anticipating the release of the ball, allowing him or her to stride forward or whatever that player may do to prepare to hit a pitched ball. In a one wheel configuration, changing the position or angle of one or both pinch pads 125 imparts a different spin to the ball changing the trajectory.

Propelling head 105 (also referred to as a throwing head) is attached to a yoke frame 130. Propelling head 105 includes a powered wheel 110 and wheel motor 135 that are affixed to and integrated with a wheel guard 140, which may be formed of one or more parts to house wheel 110. Wheel guard 140 may be formed of plastic, metal or other suitable material, and blocks access to a large portion of wheel 110 to prevent pieces that may result from fragments of a disintegrating wheel from hitting anyone near the apparatus including an operator or a batter. Wheel guard 140 also prevents the operator from accidentally touching a moving wheel while operating apparatus 100. Such an occurrence might happen if the operator is watching the player during practice and not focusing on his operation of the apparatus. Wheel 110 may rotate at speeds as fast as 3000 RPM with fourteen inch wheels propelling a ball as fast as approximately 70 miles per hour or more. This is required in the operation of the apparatus since human pitchers are known to routinely pitch balls that fast. It should be understood that wheels of other sizes may also be used.

A stand 145 for ball propelling head 105 is in the shape of a tripod formed of legs 150*a*, 150*b*, 150*c* each having a rubber safety tip 155*a*, 155*b*, 155*c*. Stand 145 allows for stability on uneven ground and legs 150 may be independently adjustable to different heights to make throwing head 105 level. Stand 145 may raise ball propelling head 105 high enough to approximate the height of a pitcher's arm when he releases a pitched ball. A ball pitched from such a height will more accurately mimic a ball pitched by a human pitcher.

Wheel 110 and pinch pads 125 are configured in ball propelling head 105 to form aperture 120 through which a ball (see FIG. 1*i*) to be thrown is visible just before it is launched by ball propelling head 105. Propelling head 105 is supported by yoke frame 130 that that pivots on support post 165 that fits in the top of stand 145. Pivoting throwing head 105 in one direction or the other allows the ball to be aimed towards a batter, a fielder or in any desired direction. Motor 135 is positioned to propel wheel 110. Varying the speed of motor 135 likewise varies the speed of wheel 110 allowing a person operating apparatus 100, who is not the batter, but, perhaps a coach or another player, to provide a series of pitches to the batter having different types of "action" such as a curve ball, a slider, a fastball, etc. The speed is varied by the operator using a control box 170 having a control knob 175 for motor 135 mounted on yoke frame 130 or wheel cover 140. Control box 170 may also house switches, lights and other knobs for operational control and feedback including but not limited to an on/off power switch for apparatus 100 and lights indicating on/off, malfunction, etc.

Motor 135 is mounted on wheel guard 140 or yoke frame 130 proximate to drive wheel 110. Wheel guard 140 is affixed to yoke frame 130 to form throwing head 105. An elevational control 180 allows the operator to adjust the angle of propelling head 105 relative to the ground at which a ball leaves propelling head 105. Elevational control 180 may be a crank with a threaded rod, worm-type gear or other geared apparatus that adjusts the height and/or angle of propelling head 105 in the up-down direction thereby positioning the height of the ball trajectory as it passes in front of the batter. It also allows machine 100 to be adjusted for fielding practice. Aiming it low produces grounders, aiming it a mid-level produces line drives and aiming it high produces fly balls or pop-ups. Variable speed motor 135 is mounted on wheel guard 140, which also forms a housing onto which chute 115 and yoke frame 130 may be attached.

Pinch pads 125 are mounted on propelling head 105 opposite the peripheral edge 190 of wheel 110. In one embodiment, there are two pinch pads 125*a*, 125*b* extending above and to the sides of peripheral edge 190 of wheel 110 as can be seen in FIG. 1*h*. Each pinch pad has an angled surface 196*a*, 196*b* that is angled towards the periphery of wheel 110 and together form the upper boundary of aperture 120 from which a ball is launched. It should be understood that angled surface 196 of pinch pads 125 may also be configured with a curvature (see FIG. 1*j*) to approximate the shape of a ball and thereby provide better grip as ball 203 passes through aperture 120. Pinch pads 125 are typically made of hardened, but textured rubber or plastic to provide grip and pressure to cause the snubbing of ball 203 against pinch pads 125 as it contacts peripheral edge 190 of wheel 110 as passes through aperture 120. It is anticipated that pinch pads 125 will wear out and can be easily replaced by removing them from bracket 199 and installing new ones.

Pinch pads 125 are supported by arms 197*a*, 197*b* that extend from wheel guard 140. Each pinch pad 125 is held in place on arm 197*a*, 197*b* by a pinion 198*a*, 198*b* that is loosened or tightened against a pinch pad bracket 199*a*, 199*b* to allow pinch pad 125 to be adjusted to accommodate different ball sizes and to change the shape of aperture 120. Changing the relative positions of the pinch pads 125*a*, 125*b* by adjusting pinions 198*a*, 198*b* will alter the spin of the ball as it is launched because the pressure at each pinch pad and at wheel 110 will be different as the ball enters and exits aperture 120. FIG. 1*i* is the same view as FIG. 1*h* except that it includes a ball 203 that has rolled down chute 115, and positioned in aperture 120 between the angled surfaces 196*a*, 196*b* of pinch pads 125*a*, 125*b* and peripheral edge 190 of wheel 110 just before it is launched. A set of handles 202*a*, 202*b* integrated with each of pinch pad bracket 199*a*, 199*b* provide a convenient place so that two people, each gripping a handle 202 on either side can together carry throwing head 105 when required.

Stand 145 is shown as a three-legged tripod on which yoke frame 130 is mounted using support post 165 extending from the bottom of yoke frame 130. It should be understood that stand 145 may be configured in other ways including more legs for support. In addition to being a connection plate for support post 165, frame 130 also forms a base that allows a stable and transportable combination. Ball propelling head 105 is mounted atop stand 145 by affixing it to yoke frame 130. A first transport wheel 185*a* positioned on one side of pitching apparatus 100 and a second transport wheel 185*b* positioned on the opposite side of pitching apparatus 100 are attached to a subframe 160, and allow easy transportation of pitching apparatus 100. The two rear tripod legs 150*a*, 150*c* are preferably removable and when apparatus 100 is lowered down in a rotating motion onto wheels 185*a*, 185*b*, it can be guided by using the front tripod leg 155*b* as a steering lever.

A fine adjustment subsystem 200 is shown integrated in an arm or platform 205 extending from the center point 210 of tripod-shaped stand 145, and to which the top of front leg 155*b* is attached. Fine adjustment subsystem 200 allows the variation of a pitch trajectory to be finely adjusted for in the horizontal direction as it crosses the plate or other area in front of the batter (i.e. moving the pitch location from an inside pitch to an outside pitch within or outside the strike zone). Fine adjustment subsystem 200 is shown in more detail in FIGS. 2-3.

Powered wheel 110 preferably includes a concave ball engaging peripheral surface 190 to allow the maximum surface of the wheel to contact the ball as it passes over wheel 110. The concave shape of the peripheral surface or edge 190 of wheel 110 is best seen in FIGS. 1*g*-1*i*.

The configuration of wheel 110 on the bottom and pinch pads 125*a*, 125*b* in a pair of two on top forms aperture 120 with a gap 122 between pinch pads 125*a*, 125*b* that allows the practicing player to view the oncoming balls as they come down chute 115 before they are launched. This is also a safety feature since batters are less likely to be inadvertently hit by a pitch since they can see if a ball is in the process of being thrown. Aperture 120, through which the ball must pass as it contacts wheel 110 and is snubbed by pinch pads 125*a*, 125*b*, allows the practicing player to see the ball as it moves down chute 115 before it is launched towards him. The uninterrupted visibility of the ball as it rolls down chute 115 and behind gap 122 before being launched through aperture 120 allows the batter to get a sense of the timing of ball 20 coming so he can anticipate striding forward or whatever that player may do in preparation for hitting a ball pitched towards him or her. The ability for the batter to see the ball during the entire launch process provides an emulation of the timing of a pitcher winding up to throw a pitch.

Figure 1K:
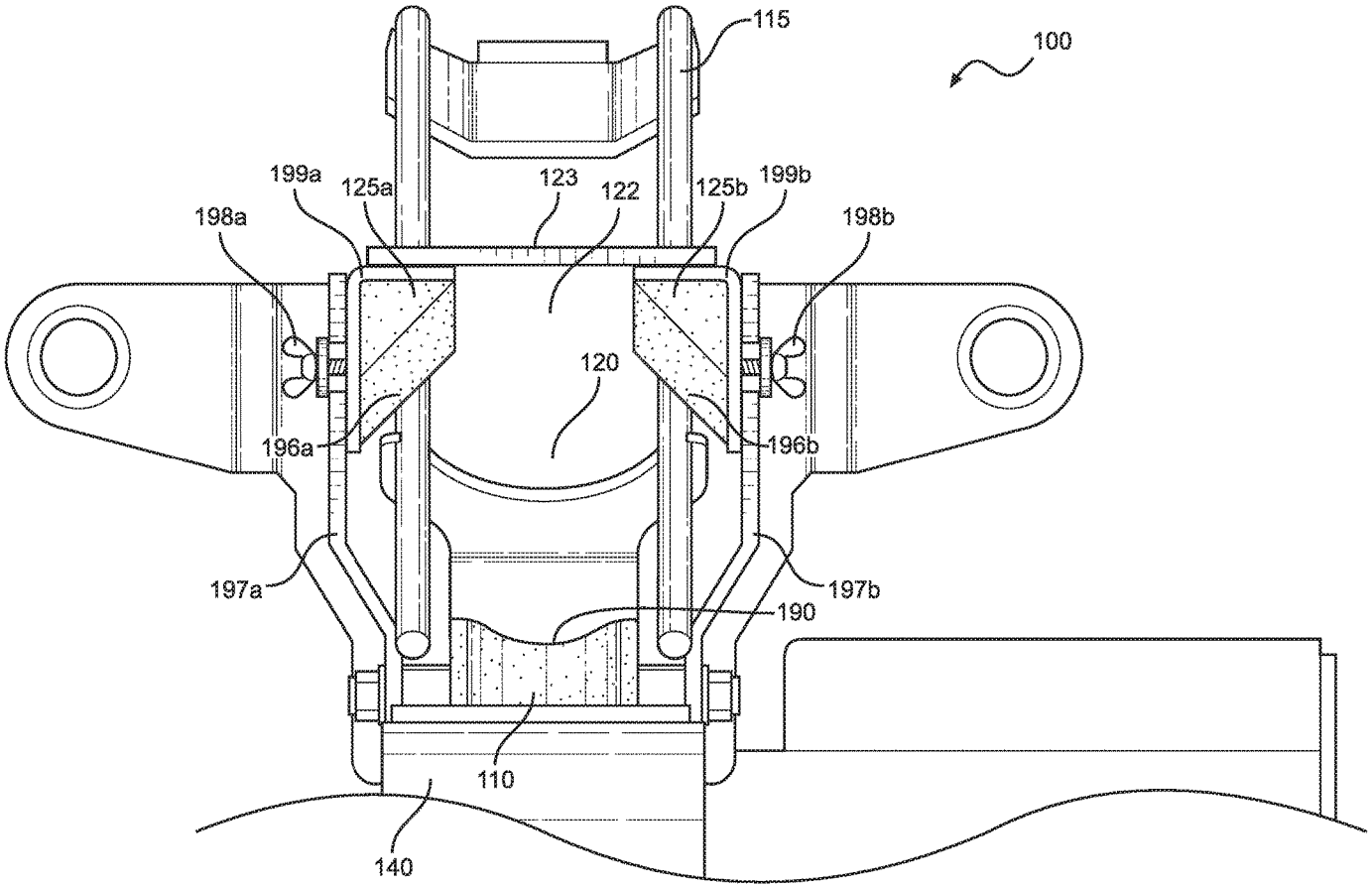

It should be understood that the timing and the uninterrupted visibility of the ball is as it rolls down chute 115 and into aperture 120 still exists even if the gap is not a completely formed gap, as long as the player can still see the ball throughout its entire descent along chute 115. For example, while a complete gap as shown in FIGS. 1*f*-1*j* is preferred, a gap with a limited or partial interruption still allows a player to maintain timing for a pitched ball from apparatus 100. For example, if a narrow stabilizing bar 123 is installed between brackets 199*a*, 199*b* as shown in FIG. 1*k*, the ball is still visible to the player without interruption. Therefore, it should be understood, that as long as the visibility of ball 203 on chute 115 is only partially blocked by a portion that is less than approximately a diameter of a ball being pitched, the player's timing, while compromised to some degree, will still generally offer the benefits as described. In other words, as long as the player can view at least a portion of the ball at all times as it rolls down chute 115, the benefits of the timing will be achieved.

The invention has been described as being an apparatus for propelling balls, particularly stick-hittable balls. The preferred balls include, for example, baseballs, softballs, handballs, tennis balls, cricket balls, (baseballs, softballs, and cricket balls are specifically defined herein as the stick-hittable balls, and may be of slightly differing sizes and weights depending on the precise league and region of use) and the like can beneficially be used in the practice of this invention. The general key to the balls that would be beneficially used in this invention are those that are thrown to be struck or hit or the like by a player with a stick or glove or racket. The apparatus may also be used for practice with catching balls, including for fielding grounders, line drives, fly balls and pop-ups.

The use of a wheel and pinch pad configuration as described allows less wear on the balls used for practice than a typical one-wheel machine. When used in practice, this arrangement provides better accuracy, while providing a better gripping surface between ball 203 and wheel 110 due to the snubbing action imposed on ball 203 as it is "pressed" against pinch pads 125*a*, 125*b* when it passes through aperture 120. The efficacy of wheel 110 is further improved by using a concave surface 190 at the periphery of wheel 110. This is important since the balls are being accelerated from zero to approximately seventy miles per hour in a fraction of a second. Aperture 120 is shown as being defined by interstitial space between the wheel 110 and pinch pads 125*a*, 125*b*. The ball will always roll downwardly through chute 115; therefore, the player will always have a view of the ball as it descends, throughout the launch process and during its flight towards him. Propelling head 105 is mounted on yoke frame 130 which pivots. The ball rolls down chute 115 to the area where the edge of wheel 110 and the surface of each of pinch pads 125*a*, 125*b* come together.

A chute handle 195 is affixed to the end of chute 115. Chute handle 195 may be gripped by an operator of apparatus 100 to pivot throwing head 105 around pivot point 210 to adjust the horizontal and/or vertical trajectory of a ball pitched from throwing head 105. This movement is useful for large scale pivotal movements of throwing head 105 such as for fungo work, line drives and fly balls. For micro-movements or fine, highly accurate small adjustment such as when pitching practice balls to a batter, the operator may use the fine adjustment subsystem 200 shown in detail in FIGS. 2-3. Chute handle 195 may also act as a connector for automatic ball feeders.

It should be understood that the structural components of propelling head 105, including but not limited to yoke frame 130, wheel guard 140, subframe 160, support post 165, pinch pad arms 197 and other components may be configured using a number of different designs without regard to altering the functional aspects of the invention. As such, the use of the term "frame" may describe one or more of these components alone or in combination that provides a support housing for the different components of propelling head 105.

Figure 2:
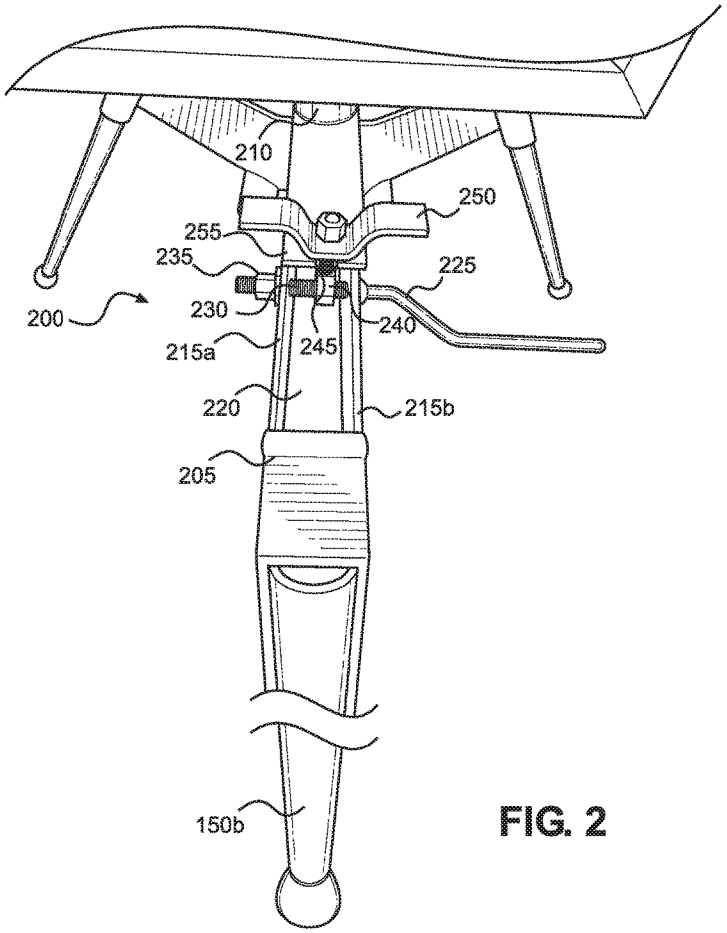
FIG. 2 is a front perspective view of a detail of the stand showing a fine adjustment subsystem.
Figure 3:
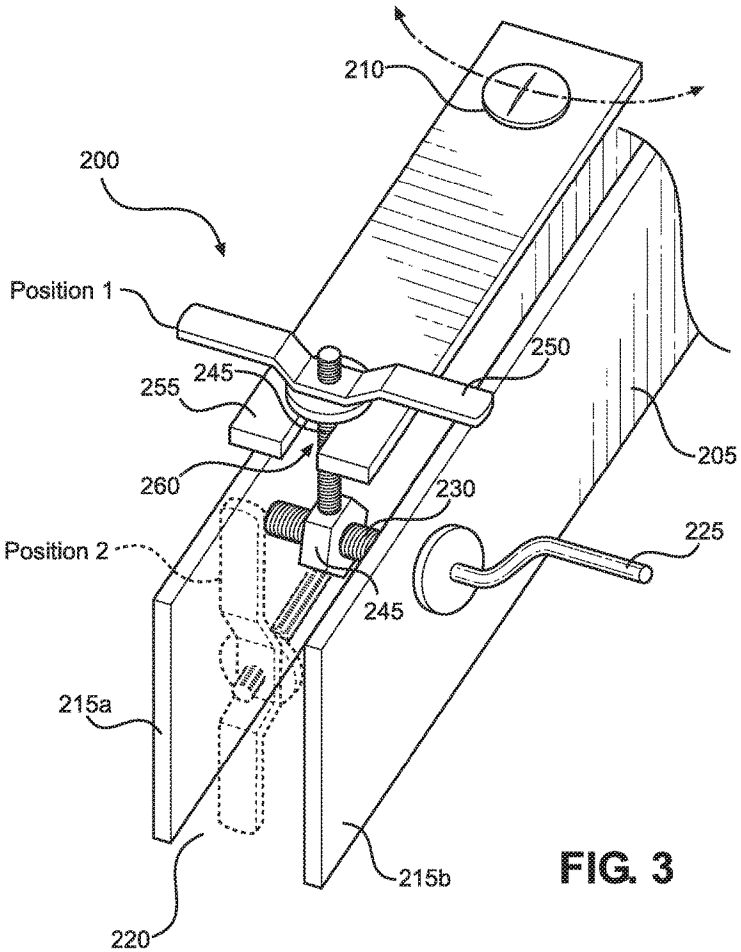
FIG. 3 is a detailed angled perspective view of the fine adjustment subsystem of FIG. 2.

FIG. 2 is a front perspective view of a detail of FIG. 1*a* showing fine adjustment subsystem 100, and FIG. 3 is a detailed angled perspective view of fine adjustment subsystem 200 of FIG. 2 showing the two positions of a locking mechanism for use in the subsystem. Referring to FIGS. 2 and 3, subsystem 200 is configured to allow an operator to finely adjust the horizontal position of propelling head 105. The fine adjustment varies a trajectory of a pitch in a horizontal plane as it crosses the plate or other area in front of the batter (i.e. moving the pitch location from an inside pitch to an outside pitch within or outside the strike zone).

Subsystem 200 is formed of platform or arm 205 which has two side frames 215*a*, 215*b* and a gap 220 between them. A crank 225 with a threaded portion 230 is fitted between side frames 215*a*, 215*b* and is held in place by a nut 235 on the opposite side of platform 205 from crank 225. An adjustment nut 240 on threaded portion 230 of crank 225 moves back and forth on threaded portion 230 between side frames 215*a*, 215*b* in gap 220 as crank 225 is turned. A locking mechanism formed of an extension rod 245 attached to adjustment nut 240 has a winged lock 250 mounted to the end of rod 245. Loosening and tightening of winged lock 250 allows rod 245 to be adjusted during operation of the pitching apparatus 100. A pivot point 210 on tongue 255 is located near the end of arm 205 through which an axis passes and about which propelling head 105 pivots on yoke frame 130 in continuous fine adjustment increments as crank 225 is turned to move tongue 255 on which throwing head 105 and yoke frame 130 are pivotally mounted.

FIG. 3 shows the operation of fine adjustment subsystem 200 and the disengagement of rod 245 for large scale adjustment. In a first position, extension rod 245 is positioned within a slot 260 in the end of tongue 255. In this first position (Position 1), winged lock 250, which is screwed onto extension rod 245 can be tightened down and locked onto tongue 255 to hold it in place at a desired position. Once fine adjustment 200 is locked, operation of pitching device 100 will pitch balls along a particular directory and each pitch will be on the same trajectory. To finely adjust the trajectory so that ball placement is more to the inside or outside relative to the batter, winged lock 250 is loosened but maintained in the first position inside of slot 260 on tongue 255. In this position with lock 250 loosened, tongue 255 moves with rod 245 in either position about pivot point 210. By turning crank 225 one way or the other, adjustment nut 240 is repositioned along threaded portion 230 of crank 225. Using this operation, slight adjustments can be made by the operator after each pitch. If a single positioned is desired for practice, winged lock 250 is rotated to tighten it down against tongue 255 to hold it firmly in that desired position. That way, a player can practice a pitch with a particular trajectory over and over again. Tightening down wing lock 250 ensures that the recoil of the throwing head does not make any slight movements to the position between pitches.

It should be understood that the rotation of crank and the adjustment of extension rod 245 is in very small increments because it is moved along the threads of threaded portion 230 of crank 225. This allows an operator to vary the horizontal pitch location very slightly across the strike zone of the batter standing at the plate. For the full range of the crank, the difference in horizontal pitch position for the batter may be, for example, approximately in the range of 12 to 18 inches. It could be made more or less depending what's desired. The ease and speed with which the horizontal pitch position may be adjusted using subsystem 200 means that an operator can vary pitch location between each pitch in minimal time.

For large changes in the horizontal position of the trajectory, particularly for fielding practice where it may be desirable to launch balls to players at different positions with each throw either for the practice of ground balls, line drives, fly balls and pop-ups for either infielders or outfielders, wing lock 250 is loosened and rotated down into position 2 between frame elements 215*a* and 215*b*. With rod 245 rotated down and out of slot 260 on tongue 255, tongue 255 freely rotates around pivot point 210. An operator of apparatus 100 uses handle 195 on the end of chute 115 to rotate throwing head 105 to any desired position. Throwing head 105 may be maintained in one position for multiple throws or rotated by the operator after each throw to generally aim the ball trajectory in the area of a player. Even though the recoil of the throwing head may slightly alter the position of a throw while winged lock 250 is in Position 2 and tongue 255 is free to rotate about pivot point 210, any slight changes resulting from the recoil are not significant for fielding practice in the same way as batting practice where small adjustments and maintaining a particular position are more critical.

In an alternative embodiment, tongue 255 may include a hinged portion with a set of teeth at the end to engage a toothed gear attached to the top of arm 205 and with a handle for turning the toothed gear. Hinged portion has a first position where it engages toothed gear and a second position where it swings out of engagement with toothed gear. In that way, it operates in the same manner as the first embodiment with a first mode for small adjustments and a second mode for large adjustments. When in the first position, tongue 255 may be clamped against arm 205 to maintain tongue 255 and throwing head 105 in the same position for multiple throws.

While the invention has been described with respect to the FIGS. 1-3, it will be appreciated that many modifications and changes may be made by those skilled in the art without departing from the spirit of the invention. Any variation and derivation from the above description and drawings are included in the scope of the present invention as defined by the claims. For example, two or more of the yoke frame, the wheel guard, the subframe, the support post and the pinch pad arms may be integrated in a single frame that is used as a housing for the propelling head.

The invention claimed is:

1. An apparatus for pitching practice balls comprising:

a ball propelling head comprising:

a frame;

a throwing wheel with a peripheral edge configured to engage a ball mounted to the frame;

a variable speed motor configured to power the wheel;

at least two pinch pads affixed to the frame and configured with a gap between pinch pads, each pinch pad having a surface angled towards the peripheral edge of the wheel wherein the angled surface of each pinch pad and the peripheral edge of the wheel define an aperture through which a ball is propelled by the wheel; and an inclined ball chute that is open along an upper portion and configured to support a ball rolling downward along a lower portion, the chute affixed to the frame and aligned with the gap, the chute having a top end, and a bottom end terminating at the aperture;

a stand on which the frame is supported at a distance above the ground;

wherein, a ball introduced at the top end of the chute rolls down the chute supported by the lower portion to the bottom end of the chute and into the aperture to be propelled by the wheel; and further wherein, during an entire period of descent as the ball rolls down the inclined ball chute, the ball is continuously visible, at least in part, to a batter: (a) on the chute behind the gap between the pinch pads; and (b) in the aperture where it is propelled by the wheel.

2. The apparatus of claim 1 wherein the angled surface of each pinch pad is curved.

3. The apparatus of claim 1 further comprising an adjustment component removably affixed to the frame and each pinch pad, and configured to adjust the relative position of each pinch pad.

4. The apparatus of claim 1 wherein a peripheral edge of the wheel is concave in shape.

5. The apparatus of claim 1 further comprising a control panel, wherein the control panel comprises a power switch and a knob for varying the speed of the motor.

6. The apparatus of claim 1 further comprising a wheel guard affixed to and forming a part of the frame.

7. The apparatus of claim 1 further comprising a chute handle attached to the top end of the chute configured pivot the frame on the stand to adjust a trajectory of a pitched ball.

8. The apparatus of claim 1 wherein the stand comprises at least three legs.

9. The apparatus of claim 8 wherein one of the at least three legs further comprises an extended portion in which the adjustment subsystem is housed.

10. The apparatus of claim 1 further comprising a fine adjustment subsystem configured to provide fine adjustments to the trajectory of a ball pitched.

11. The apparatus of claim 1 further comprising a pair of transport wheels mounted to the frame on which the ball propelling head may be transported.

12. The apparatus of claim 1 further comprising an elevational adjustment.

13. The apparatus of claim 1 wherein the pinch pads snub the ball as the ball contacts the pinch pads imparting spin to the ball during pitching.

14. A method for pitching practice balls comprising:

providing a ball propelling head comprising:

a frame;

a throwing wheel with a peripheral edge configured to engage a ball for throwing;

a variable speed motor configured to power the wheel;

at least two pinch pads affixed to the frame and configured with a gap between pinch pads, each pinch pad having a surface angled towards the peripheral edge of the wheel wherein the angled surface of each pinch pad and the peripheral edge of the wheel define an aperture through which a ball is propelled by the wheel; and an inclined ball chute that is open along an upper portion and configured to support a ball rolling downward along a lower portion, the chute affixed to the frame and aligned with the gap, the chute having a top end, and a bottom end terminating at the aperture;

providing a stand on which the frame is supported at a distance above the ground;

defining an aperture in an area between the angled surface of each pinch pad and the peripheral edge of the wheel;

wherein, a ball is introduced at the top end of the chute and the ball rolls to the bottom end of the chute supported by the lower portion and into the aperture to be propelled by the wheel; and wherein, during an entire period of descent as the ball rolls down the chute, the ball is continuously visible, at least in part, to a batter: (a) on the chute behind the gap between the pinch pads; and (b) in the aperture where it is propelled by the wheel.

15. The method of claim 14 wherein the angled surface of each pinch pad is curved.

16. The method of claim 14 further comprising adjusting the relative position of the pinch pads.

17. The method of claim 14 wherein a peripheral edge of the wheel is concave in shape.

18. The method of claim 14 wherein the ball propelling head further comprises a control panel with a power switch and a knob for varying the speed of the motor.

19. The method of claim 14 wherein the ball propelling head further comprises a wheel guard affixed to and forming a part of the frame.

20. The method of claim 14 wherein the ball propelling head further comprises a chute handle attached to the top end of the chute configured to pivot the frame on the stand to adjust a trajectory of a pitched ball.

21. The method of claim 14 wherein the stand comprises at least three legs.

22. The method of claim 14 wherein the stand further comprises a fine adjustment subsystem configured to provide fine adjustments to the trajectory of a ball pitched.

23. The method of claim 22 wherein one of the at least three legs further comprises an extended portion in which the adjustment subsystem is housed.

24. The method of claim 14 wherein the throwing head further comprises a pair of transport wheels mounted to the frame on which the ball propelling head may be transported.

25. The method of claim 14 wherein the throwing head further comprises an elevational adjustment.

26. The method of claim 14 further comprising snubbing the ball on the pinch pads as the ball contacts the pinch pads imparting spin to the ball during pitching.

* * * * *